US006775928B2

(12) United States Patent
Grande et al.

(10) Patent No.: US 6,775,928 B2
(45) Date of Patent: Aug. 17, 2004

(54) LACING SYSTEM FOR SKATES

(75) Inventors: Dodd H. Grande, Seattle, WA (US); Darrin J. Haugen, Seattle, WA (US); Mark S. Williams, Renton, WA (US); John E. Svensson, Vashon, WA (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 10/165,602

(22) Filed: Jun. 7, 2002

(65) Prior Publication Data

US 2003/0226284 A1 Dec. 11, 2003

(51) Int. Cl.[7] ..... A43B 11/00

(52) U.S. Cl. ..... 36/50.1; 36/50.5; 36/54; 24/712.5; 24/115 G

(58) Field of Search ..... 36/50.1, 50.5, 36/54, 115; 24/712.5, 115 G

(56) References Cited

U.S. PATENT DOCUMENTS 1,261,152 A * 4/1918 Mullarky ..... 36/89
2,200,895 A 5/1940 Rio
3,965,544 A * 6/1976 Boden
4,114,297 A * 9/1978 Famolare, Jr.
4,156,574 A * 5/1979 Boden
4,878,269 A * 11/1989 Anscher et al.
5,333,398 A * 8/1994 Seo
5,430,960 A * 7/1995 Richardson
5,435,044 A * 7/1995 Ida
5,454,140 A * 10/1995 Murai
5,477,593 A 12/1995 Leick
5,566,474 A 10/1996 Leick et al.
5,572,770 A * 11/1996 Boden
5,924,178 A 7/1999 Holmberg
5,940,990 A * 8/1999 Barret
6,038,791 A * 3/2000 Cornelius et al.
6,076,285 A * 6/2000 Caeran et al.
6,339,867 B1 1/2002 Azam
6,467,195 B2 * 10/2002 Pierre et al.
6,550,159 B1 * 4/2003 Madore ..... 36/115

* cited by examiner

*Primary Examiner*—Ted Kavanaugh
(74) *Attorney, Agent, or Firm*—Christensen O'Connor Johnson Kindness PLLC

(57) ABSTRACT

A skate upper (120) of the type having an elongate vamp (122) with lace keepers (123) and a tongue (130) disposed generally in the vamp is provided with an attached lace locker. The lace locker (150) fixedly attached near the top of the upper, preferably to an upper portion of the tongue. A lace (124) is retained by the lace keepers and releasably engaged by the lace locker. A strap assembly (126) is provided below the lace locker. A lace guide (140) is attached to the tongue, below the lace locker and below the strap assembly. The invention positions the lace locker more conveniently above the strap assembly, and permits the user to tighten and loosen the lace with one hand.

17 Claims, 4 Drawing Sheets

LACING SYSTEM FOR SKATES

FIELD OF THE INVENTION

The present invention is directed to uppers for sports footwear such as skates and, in particular, to lacing systems for uppers.

BACKGROUND OF THE INVENTION

In-line skates, quad skates, ice skates, and other sporting footwear often include a high-back boot upper that, cooperatively with the boot sole, receives the user's foot and secures the user's foot to the skate. An elongate slit, or vamp, is typically provided near the front of the upper to facilitate putting on and taking off the skate. Various mechanisms for securing the boot upper about the user's foot are known in the art. Skates, and in-line skates in particular, frequently include both a lace-type fastening system and a strap-type fastener. The lace-type securement allows the user to tighten the upper along at least a portion of the length of the vamp, providing a secure and comfortable fit for the user. Additionally, one or more strap assemblies, typically having oppositely-disposed straps attached on either side of the vamp and employing a buckling mechanism, provide a strong and secure attachment, usually near the top of the upper about the user's ankle, and sometimes also generally over the user's instep. The strap-type fastener is typically much sturdier than the lace system and therefore provides a sturdy connection that is able to withstand the stresses of even a very rigorous skater's activity, while protecting the lace from excessive stresses.

Donning such skates, however, can be tedious and inconvenient to the user, due to the multiple securement mechanisms. The inconvenience is particularly undesirable when the user is burdened with other gear such as padding, safety equipment, backpacks, and the like, that makes reaching down to the skates more difficult. Also, if the user attempts to fasten the laces and straps while standing on the skates, fastening the these securement mechanisms may be even more problematic due to the need to maintain balance on the skates.

Mechanisms that alleviate the need to tie the laces are known, including for example, devices often referred to as lace fasteners, or lace lockers. Lace lockers typically provide a lace-clamping mechanism that is slidably disposed on the laces and is adapted to releasably hold the laces in a tightened configuration. An example of a lace locker is disclosed in U.S. Pat. No. 5,477,593 to Leick. Leick discloses a lace locker having a circular locking member slidably disposed in a converging cavity of a body that is adapted to receive laces. When the locking member is near the narrow end of the cavity, it clampingly engages the laces, restraining the laces. When the locking member is near the wider end of the cavity, the locking member releases the laces, permitting the lace locker to slide along the length of the laces. The locking member is biased in the locking position, i.e., toward the narrow end of the cavity, and a "pusher" button is attached to the locking member, permitting the user to move the locking member against the biasing force, to release the laces.

Another lace locker mechanism, operating on similar principles, is disclosed in U.S. Pat. No. 6,339,867 to Azam. Azam discloses a device similar to that disclosed by Leick, but having a release mechanism that locks the lace locker in the unlocked position to facilitate disengagement or loosening of the lace.

These prior art lace lockers, however, require two hands to engage. The user must grasp the lace in one hand and grasp the lace locker with the other hand to push the lace locker along a portion of the length of the lace. Also, to remove a boot using these lace lockers, the user must first loosen the lace locker, and then typically pull outwardly on the tongue of the boot. Another disadvantage of prior art lace lockers is that the lace locker must be positioned generally at the top of the uppermost lace keeper to hold the lace in the tightened position. This may be inconvenient in boots that also have a strap-type fastener, as the lace locker may interfere with the desired location of the strap and/or buckle. Interference between the strap and the lace locker may also result in damage to either or both of these devices.

SUMMARY OF THE INVENTION

The object of the present invention is to overcome the disadvantages of the prior art noted above and to provide a skate upper having a lacing system that the user can tighten and/or loosen with a single hand. The present invention provides an upper for sporting footwear, such as in-line skates, wherein the upper has an elongate vamp to facilitate donning and removing the footwear. A lace locker is attached near the top of the upper, preferably near the top of the tongue of the upper. The lace locker permits the user to pull upwardly on the lace with one hand, without grasping the lace locker, to tighten the lace about the user's foot. The lace locker includes a button for releasing the lace, whereby the user can grasp the tongue, depressing the button, and pull outwardly with one hand to loosen the laces and simultaneously move the tongue away for removal of the skate. A lace guide is optionally provided below the lace locker and above the uppermost lace keeper to guide the lace towards the lace locker.

In an embodiment of the present invention, an upper is provided having a slot or vamp with a tongue disposed generally along the vamp and a plurality of lace keepers oppositely disposed along either side of the vamp. A lace is retained by the lace keepers for tightening the upper about the foot of a user. A lace locker is attached at a top end of the upper, preferably near the top of the tongue, the lace locker clampingly engaging the lace ends such that the lace locker will maintain the lace in a tightened condition. An upward force on the lace ends permits the user to tighten the lace, while releasing that upward force permits the lace locker to re-clamp the lace. A button on the lace locker is provided that operates to release the clamping of the lace, whereby the lace ends can be slidably moved through the lace locker to tighten or loosen the lace.

In an embodiment of the invention the lace locker includes a body portion having a stitch flange, the body having a converging cavity. A sliding blocker in the cavity is biased downwardly, and includes lace-engagement edges that clamp onto the lace. A button is attached to the blocker whereby the user can move the sliding blocker against the biasing force to release the clamping engagement of the lace.

In a disclosed embodiment of the invention, the lace-engagement edges comprise a plurality of teeth to improve the gripping ability of the blocking element.

In an aspect of a disclosed embodiment of the invention, a lace guide is attached to the upper, preferably to the tongue of the upper, below the lace locker and above the lace keepers, and the lace ends are slidably disposed in the lace guide.

In another aspect of the disclosed embodiment of the invention, a strap assembly is attached to the upper, operable to secure the upper portion of the vamp in a closed position. The lace locker is attached to the top of the tongue, above the strap assembly, and the lace guide is attached to the tongue below the strap assembly.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
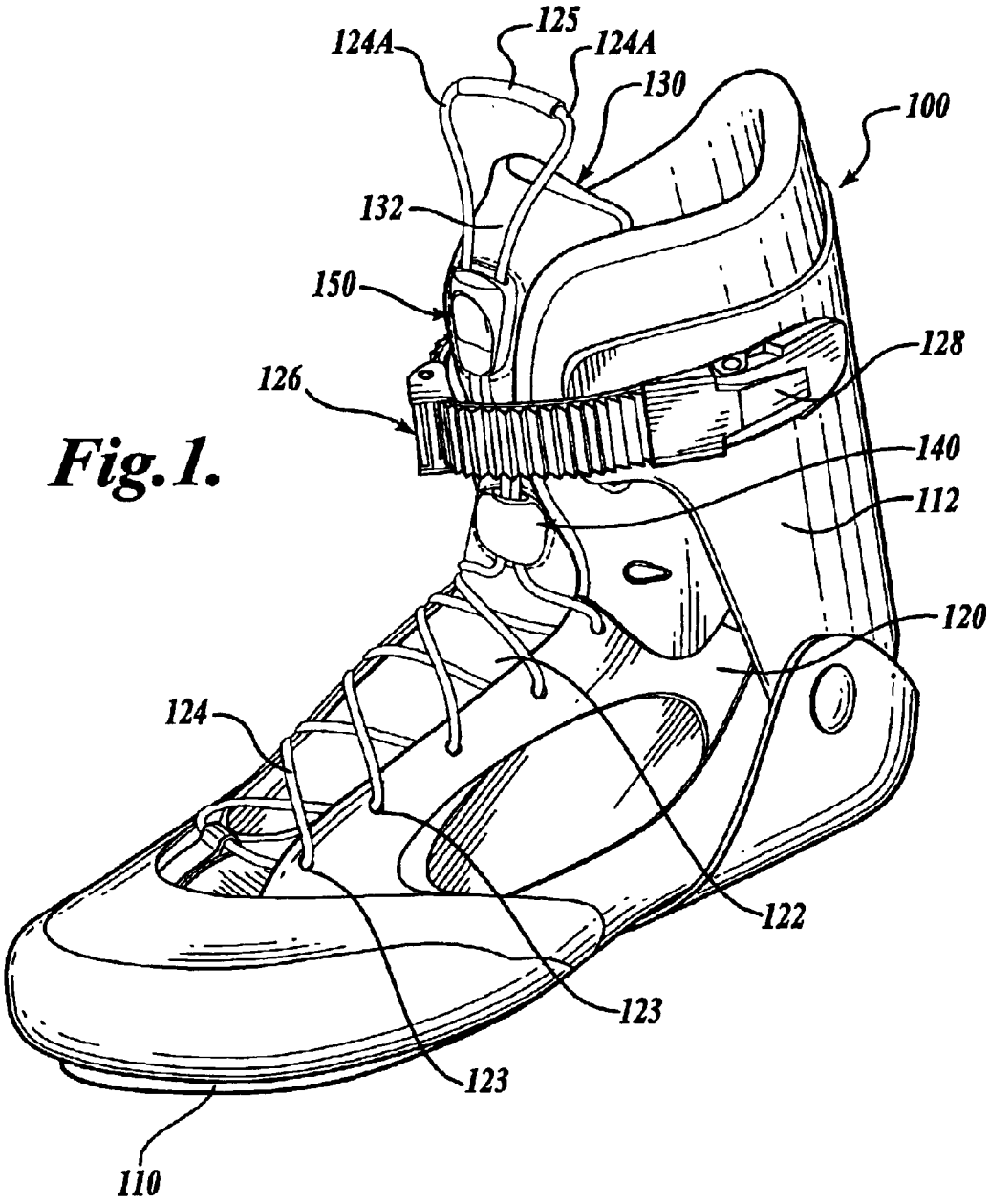
FIG. 1 is a perspective view of a sports boot for an in-line skate embodying the present invention.

An embodiment of the present invention will now be described in detail, with reference to the figures. Referring to FIG. 1, a sports boot 100 is shown that is suitable for use with, for example, an in-line skate. The sports boot 100 includes a relatively stiff and rugged sole portion 110, a semi-rigid ankle support 112, and a flexible upper 120. The sports boot 100 is adapted to receive and securely envelop the foot and ankle of a user (not shown). To facilitate putting the sports boot 100 on, the flexible upper 120 includes an elongate slot or vamp 122 that enables the user to open the upper 120 relatively widely, and permit easy insertion of the user's foot into the upper 120. A tongue 130 attaches at a lower end of the vamp 122, and extends upwardly to extend generally to the top of the vamp 122. Lace keepers 123 are provided on either side of the vamp 122, and are adapted to receive a lace 124, whereby at least the lower portion of the vamp 122 can be tightened in a closed position about the user's foot. The lace keepers 123 may be of any type as are well known in the art—for example, reinforced eyelets, loops of a sturdy material affixed to the upper, metal hooks, or hoops attached to the upper, and the like.

The lace 124 is an elongate length of material that engages the lace keepers 123, typically alternating from the left side to the right side of the vamp 122. The ends of the lace 124A extend from the top of the lace keepers 123, and may be conveniently interconnected to form a loop, for example, by tying the ends together, or with a lace connector 125. As is well known in the art, pulling on the lace ends 124A will cause the lace to pull opposite sides of the vamp 122 toward each other, to produce an adjustably tight fit about the user's foot.

In the disclosed embodiment, a strap assembly 126 including a releasable buckle 128, is provided to further tighten and releasably secure the vamp 122 in the closed position. In this embodiment, the strap assembly 126 is located near the top of the upper 120, and is attached to opposite sides of the semi-rigid ankle support 112. It will be readily appreciated to one of skill in the art that other securement apparatus might additionally or alternatively be provided. For example, it is known in the art to provide two separate strap assemblies, one disposed near the top of the upper, and a second strap assembly disposed generally over the instep of the user's foot. Alternatively, straps that completely circle the ankle portion, buckles that extend over the vamp, and tightening mechanisms such as ratchet-type buckles are also contemplated by the present invention. It is also contemplated that the strap could be attached directly to the flexible upper 120, particularly in a boot configuration without an ankle support 112.

A lace locker 150 (or lace fastener) may be attached to the upper end 132 of the tongue 130 with stitches 169. The lace locker 150 is a releasable locking mechanism for holding the lace 124 in the tightened condition. The lace locker 150 provides an easy alternative to manually tying the lace 124 with a conventional knot. As discussed in more detail below, the lace locker 150 slidably engages the lace ends 124A above the lace keepers 123. As discussed in more detail below, a blocking mechanism in the lace locker 150 restrains the lace ends 124A from sliding downwardly, and thereby relieving the tension in the lace 124. The blocking mechanism on the lace locker 150 is releasable, however, to permit the user to easily loosen the lace 124, for example to remove the boot 100. The lace locker is preferably disposed above the strap assembly 126, whereby the lace locker 150 does not interfere with proper operation of the strap assembly 126, and the strap assembly 126 does not overlie or otherwise interfere with the lace locker 150.

A lace guide 140 is also shown in the disclosed embodiment of the present invention. The lace guide may slidably receive the lace ends 124A, preferably below the ankle strap assembly 126, and above the lace keepers 123. As discussed in more detail below, the lace guide 140 may include one or more passageways that permit the lace 124 to slide between a tightened position and a loosened position, and orients the lace ends 124A such that the lace ends 124A engage the lace locker 150 with a substantially vertical orientation.

Figure 3:
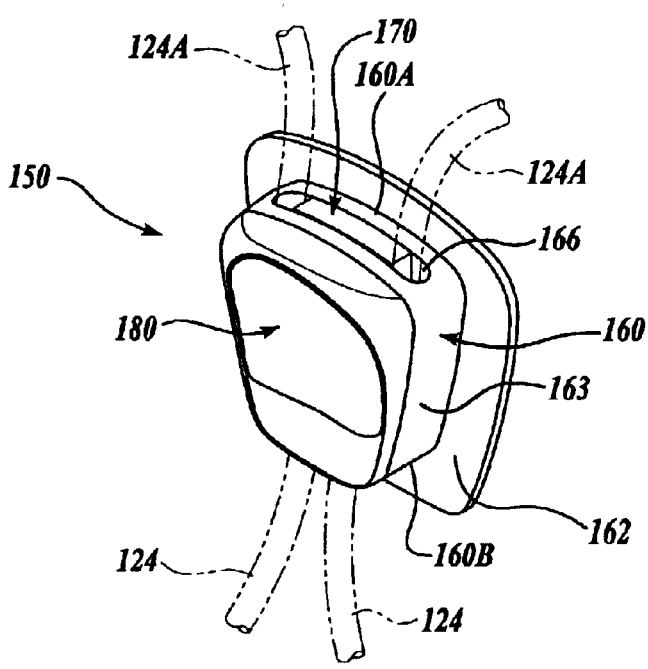
FIG. 3 is a perspective view of the lace locker shown attached to the sports boot in FIG. 1.
Figure 4:
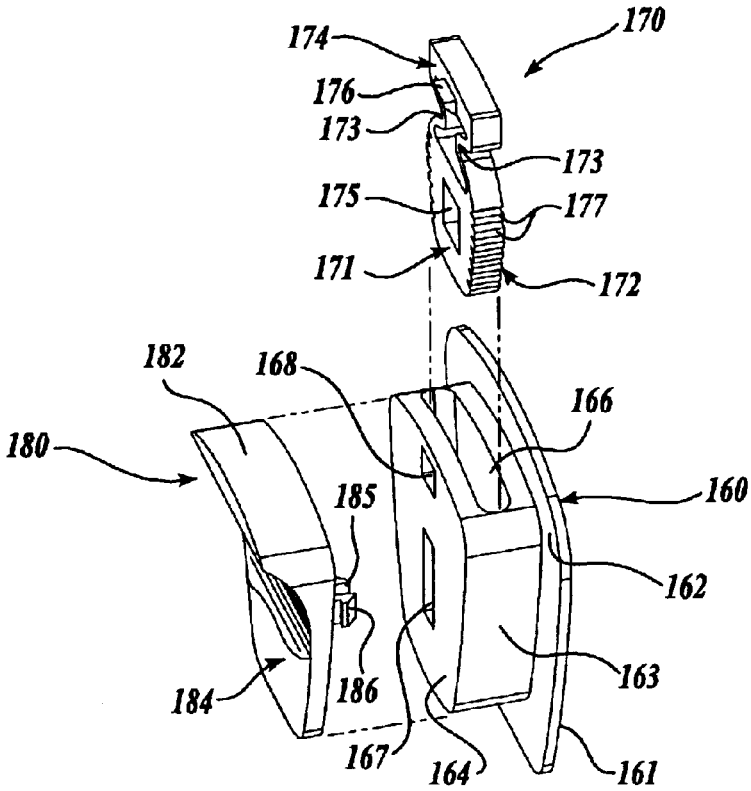
FIG. 4 is an exploded view of the lace locker shown in FIG. 3.

Refer now to FIG. 3, showing a perspective view of a preferred lace locker 150, and FIG. 4, showing an exploded view of the lace locker 150. The lace locker 150 may include, in general, an outer body portion 160, a sliding blocker 170, and a release button portion 180.

The body portion 160 has a back wall 161, including a peripheral stitch flange 162, defining a generally flat back surface of the body portion 160. A front wall 164, disposed over and generally parallel to the back wall 161, extends forwardly on oppositely disposed sidewalls 163 from the back wall 161, forming a narrow, nominally rectangular cavity 166 between the front wall 164 and the back wall 161. The sidewalls 163 are closer together at the lower end than at the upper end of the sidewalls 163, whereby the cavity 166 converges in width from the upper end 160A to the lower end 160B, as shown in FIG. 4. In the disclosed embodiment, a longitudinal slot 167 extends laterally through the center of the front wall 164. A retaining aperture 168 is also provided through the front wall 164, above the slot 167. The purpose of the longitudinal slot 167 and retaining aperture 168 will become apparent from the description below.

The sliding blocker 170 is a generally flat element, sized to slidably fit in the body portion cavity 166. The sliding blocker 170 includes a lower portion 171 having oppositely disposed lace-engagement edges 172. The oppositely disposed edges 172 preferably converge at approximately the same angle as the converging sides of the cavity 166. The sliding blocker 170 lace-engagement edges 172 cooperate with the sidewalls 163 to form a pair of oppositely disposed channels or passageways between the sidewalls 163 and the lace-engagement edges 172. These channels slidably accommodate the lace 124, and permit the sliding blocker 170 to clampingly wedge the lace 124, i.e., against the sidewalls 163. To increase the lace-gripping ability of the edges 172, in a preferred embodiment the edges 172 comprise a number of teeth 177. Alternatively, the edges 172 may be knurled or otherwise configured to securely grip against the lace 124. The sliding blocker 170 also includes an upper portion 174 that is elastically attached to the lower portion 171 with a pair of oppositely disposed spring elements 173. The upper portion 174 has a wedge-shaped locking element 176 projecting from the upper portion 174 towards the body portion front wall 164, and is sized to engage the retaining aperture 168 on the body portion 160. It will be appreciated from FIGS. 3 and 4 that when the sliding blocker 170 is fully inserted into the cavity 166, the locking element 176 engages the retaining aperture 168, thereby locking the sliding blocker 170 in the body portion cavity 166. The sliding blocker 170 is sized such that when the sliding blocker 170 is fully inserted into the cavity 166 with the locking element 176 captured in the retaining aperture 168, the spring elements 173 bias the lower portion 171 downwardly, such that the lace-engagement edges 172 clampingly engage the lace 124 between the sliding blocker 170 and the sidewalls 163. A button-reception aperture 175 is provided generally near the center of the lower portion 171, and generally aligned with the longitudinal slot 167.

The button portion 180 is a contoured element having a thicker upper end 182 and a thinner lower end 184, thereby forming a lip at the upper end 182. The button portion 180 is shaped to facilitate a user pushing upwardly on the button portion 180 with a fingertip. A split post 185 protrudes from the rearward face of the button portion 180, the split post 185 sized to slidably extend through the longitudinal slot 167 in the body portion front wall 164, to engage the button-reception aperture 175 in the sliding blocker 170. In the disclosed embodiment each half of the split post 185 includes a distal, laterally extending tab 186 such that the button portion 180 locks into place when the post 180 is fully inserted into the retaining aperture 168 by bearing against the opposite side of the sliding blocker 170. It should now be apparent that to release the laces from the clamping engagement between the sliding blocker 170 and sidewalls 163, the user pulls the button portion 180 upwardly along slot 167 to slidably move the lower portion 171 of the sliding blocker 170 upwardly toward the upper portion 174 against the biasing force of the spring elements 173. It is also contemplated that any other suitable means for attaching the button portion to the sliding blocker may be used, for example a friction fit between the post and the retaining aperture, a glued joint, and the like.

Figure 2:
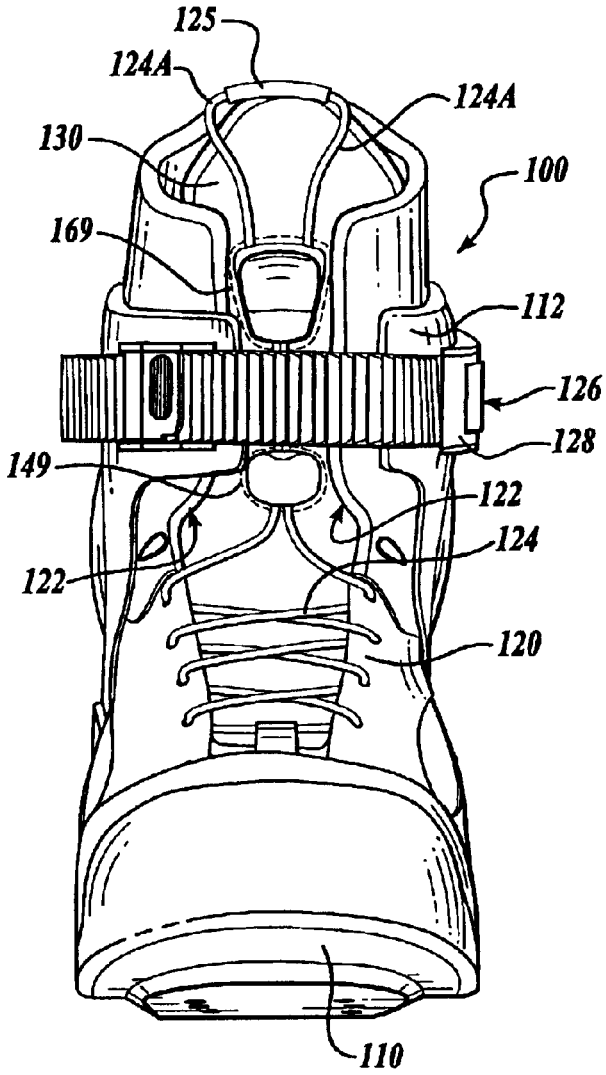
FIG. 2 is a side view of the sports boot shown in FIG. 1.
Figure 5A:
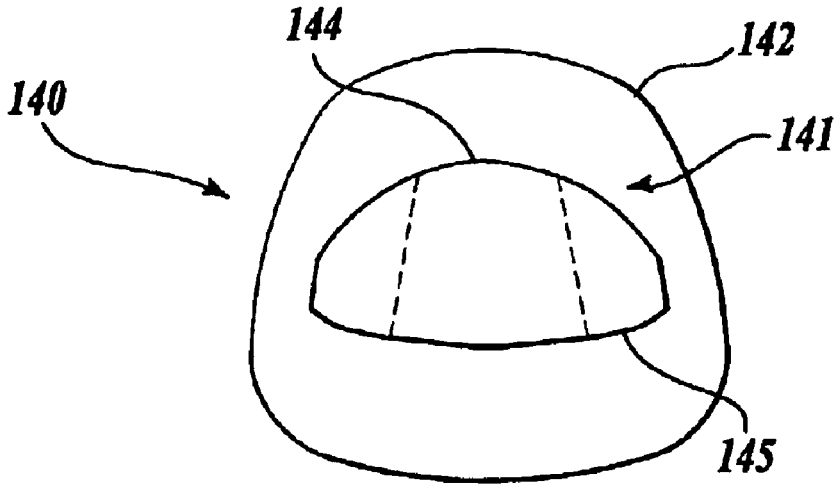
FIG. 5A is a front view of the lace guide shown in FIG. 1.
Figure 5B:
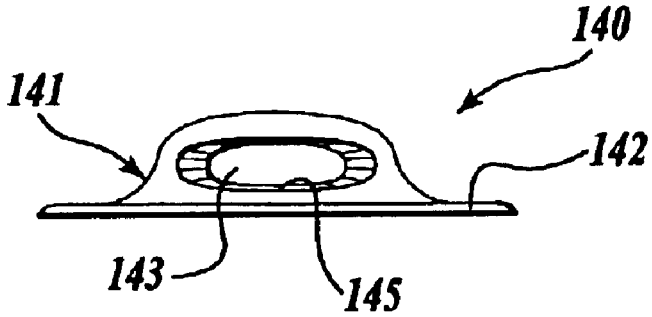
FIG. 5B bottom view of the lace guide shown in FIG. 5A

Refer now to FIGS. 5A and 5B showing a front and bottom view of the lace guide 140. The lace guide 190 is preferably disposed generally directly below the lace locker 150 and above the uppermost lace keepers 123 (see FIGS. 1 and 2). The lace guide 140 may include a main body 141 with a peripheral stitch flange 142, whereby the lace guide 140 is fixedly attached to the flexible upper 120, and preferably attached to the tongue 130 portion of the upper 120 with stitches 149. A channel or passageway 143 extends generally vertically through the lace guide body 141, the passageway 143 being sized to slidably accommodate the lace ends 124A. The passageway 143 preferably is converging upwardly, such that the passageway 143 is narrower at the top end 144 of the lace guide 140 than at the bottom end 145. The lace guide 140 aligns the lace 124 generally with the lace locker 150, turning the lace 124 from a sharply angled orientation to approximately a vertical orientation. It is also contemplated that the lace guide may alternatively include separate, angled channels for each lace end 124A, rather than a single channel for both lace end 124A.

To tighten the lace 124 on the boot 100 and about the foot of the user, the user merely reaches down with one hand and grasps, or inserts a finger through the loop formed by the lace ends 124 and the lace connector 125, and pulls. The lace 124 slidably moves through the lace guide 140 and lace locker 150 until the desired tightness is achieved. It will be appreciated that pulling on the lace 124 causes the lower portion 171 of the sliding blocker to move against the biasing force provided by spring elements 173, thereby releasing the clamping force exerted by the sliding blocker 170, and permitting the lace 124 to slide relatively easily within the lace locker 150. Releasing the lace 124 causes the sliding blocker lower portion 171 to return to the clamping position under the biasing force of the spring elements 173, augmented by the downward force exerted on the sliding blocker 170 due to the tension in the lace 124 itself. In particular, because the lace locker 150 is affixed to the boot upper 120, the user does not need to grasp the lace locker 150 with one hand while simultaneously pulling the lace 124 with the other hand, as in conventional lace lockers, but rather can tighten the lace with only one hand.

To release the tension in the lace 124, for example, when removing the boot 100 and after releasing the strap buckle 128, the user need only grasp, again with one hand, the lace locker 150 along with the upper end of the tongue 132, and pull upwardly on the button portion 180 of the lace locker 150, while pulling the tongue 130 generally away from the user. It will be appreciated that this is a quicker and simpler procedure than a conventional, free-sliding lace locker wherein the user must first loosen the lace locker and then grasp the tongue and pull it generally away from the user.

Although the present invention has been described with reference to a presently preferred embodiment, many variations on the disclosed embodiment are possible, and contemplated by the present invention. For example, although the sliding blocker 170 is described with integral biasing or spring elements 173, it will be readily apparent that separate biasing elements or biasing elements integrally incorporated into the body portion 160, could alternatively be used, or no biasing element could be used, relying rather on the tension forces in the lace to pull the blocking element into a clamped position. Similarly, although a generally rectilinear blocker lower portion 171 is disclosed, other alternative shapes for the blocker are possible—for example, and not by way of limitation, circular blocking elements that may include radially-disposed teeth, triangular blocking elements, combined or more complex shaped blocking elements, and the like. It is also contemplated that the lace-engagement edges 172 and/or teeth 177 of the sliding blocker 170 may be provided with a gripping material to improve the clamping engagement of the lace 124.

It is also contemplated that the lace locker 150 and/or the lace guide 140 may be affixed to the upper 120 at a location other than the upper portion of the tongue 130. For example, and again not by way of limitation, the lace locker could be affixed near the top of the upper 120, generally adjacent to the vamp 122, on either the left or right side. Alternatively, lace guides might be located to guide the laces around to the back side of the upper 120, with the upper lock 150 affixed near the top of the back of the upper 120.

It is also contemplated that other means for affixing the lace locker to the upper might be utilized. For example, rather than using a lace flange to stitch the lace locker onto the upper, one or more connector flanges such as rivet or bolt flanges might be utilized, or a rivet, bolt or other type of fastener through the back wall of the lace locker might be utilized. Alternatively, a fixative such as a glue might be used. In boots having a semi-rigid tongue or tongue cover, the lace locker and/or lace guide may be formed as an integral part of the tongue or tongue cover.

It will also be apparent to one of skill in the art that although the preferred boot embodiment has been described as having a flexible upper, the present invention might also be utilized with boots having a rigid, or semi-rigid, outer shell.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An upper for a sports boot comprising:

an elongate vamp having a lower portion including a plurality of oppositely disposed lace keepers, and an upright upper portion;

a tongue having an upper portion;

a lace slidably retained by the lace keepers and extending across the lower portion of the vamp, the lace including opposite end portions extending upwardly along the upright upper portion of the vamp; and a lace locker for releasably engaging the lace opposite end portions, the lace locker including a button adapted to release the engagement of the lace opposite end portions;

wherein the lace locker is attached to the upper portion of the tongue and held in an upright orientation with the button outwardly exposed, the combination enabling one-handed release of the lace locker;

and further comprising a lace guide attached to the tongue below the lace locker, the lace guide having a passageway that slidably receives the lace and is adapted to orient a portion of the lace upwardly towards the lace locker.

2. The upper of claim 1, further comprising at least one strap assembly for releasably closing the vamp, wherein the strap assembly is disposed generally between the lace locker and the lace guide.

3. The upper of claim 1, wherein the lace locker comprises a peripheral stitch flange and wherein the lace locker is attached to the upper portion of the tongue with stitches.

4. The upper of claim 3, wherein the lace locker further comprises:

a main body defining a converging cavity;

a blocking element disposed in the converging cavity wherein the blocking element is slidable between a clamping position wedging the lace between the blocking element and the main body and a releasing position; and a button portion attached to the blocking element.

5. The upper of claim 4, wherein the blocking element further comprises at least one biasing element that biases the blocking element toward the clamping position.

6. The upper of claim 4, further comprising a lace guide attached to the tongue below the lace locker.

7. The upper of claim 1, wherein the lace locker comprises a body defining a passageway and a sliding blocker having i) an upper portion lockingly engaging the body, ii) a lower portion slidably disposed in the passageway, and iii) a biasing element connecting the upper portion to the lower portion.

8. The upper according to claim 1, further comprising at least one strap assembly for releasably closing the upper upright portion of the vamp, the lace locker being disposed above the at least one strap assembly.

9. The upper according to claim 1, wherein the lace locker button is facing forwardly during use.

10. The upper according to claim 1, wherein the lace locker button includes a locked position and an unlocked position, and wherein during use the lace locker button must be continuously held in its unlocked position in order to allow release of the lace end portions.

11. A skate comprising:

an upper having a top portion adapted to wrap about the ankle of a user and a bottom portion adapted to cover the foot of a user, wherein the upper includes an elongate vamp having a lower portion including a plurality of oppositely-disposed lace keepers and an upright upper portion, and a tongue portion disposed generally along the elongate vamp;

a sole fixedly attached to the bottom portion of the upper;

a lace slidably retained by the lace keepers such that the lace extends across the lower portion of the vamp, the lace including opposite end portions extending distally from the lace keepers along the upright upper portion of the vamp; and a lace locker releasably clamping the lace opposite end portions, the lace locker including a button adapted to release the engagement of the lace opposite end portions;

wherein the lace locker is attached to the top portion of the tongue and held in an upright orientation with the button outwardly exposed, the combination enabling one-handed release of the lace locker;

and further comprising a lace guide attached to the tongue below the lace locker, the lace guide having a passageway that slidably receives the lace and directs the lace upwardly towards the lace locker such that the lace does not cross the elongate vamp transversely between the lace guide and the lace locker.

12. The skate of claim 11, further comprising at least one strap assembly attached to the upper and disposed generally between the lace locker and the lace guide.

13. The skate of claim 11, wherein the lace locker includes a peripheral stitch flange an wherein the lace locker is attached to the top portion of the upper with stitches.

14. The skate of claim 13, wherein the lace locker further comprises:

a main body defining a converging cavity;

a blocking element dispose in the converging cavity wherein the blocking element is slidable between a clamping position wedging the lace between the blocking element and the main body and a releasing position; and a button portion attached to the blocking element.

15. The skate of claim 14, wherein the blocking element further comprises at least one biasing element that biases the blocking element into the converging cavity.

16. The skate of claim 15, further comprising a lace guide attached to the tongue below the lace locker.

17. The skate of claim 11, wherein the lace locker comprises:

a body member having (i) a back wall having peripheral stitch flange;

(ii) a front wall disposed generally parallel to the back wall, the front wall having a longitudinal slot therethrough; and (iii) oppositely disposed sidewalls disposed between the front wall and the back wall, wherein the back wall, front wall and sidewalls defining a converging cavity therebetween;

a sliding blocker disposed in the converging cavity, the sliding blocker having (i) an upper portion lockingly retained in the body member;

(ii) a lower portion slidably disposed in the converging cavity; and (iii) at least one biasing element disposed between the upper portion and the lower portion to bias the lower portion into the converging cavity; and a button coupled to the sliding blocker lower portion through the longitudinal slot in the front wall of the body member.

* * * * *

UNITED STATES PATENT AND TRADEMARK OFFICE

CERTIFICATE OF CORRECTION

PATENT NO. : 6,775,928 B2
DATED : August 17, 2004
INVENTOR(S) : D.H. Grande et al.

It is certified that error appears in the above-identified patent and that said Letters Patent is hereby corrected as shown below:

Column 8,
Line 57, "element dispose" should read -- element disposed --

Signed and Sealed this

Fourteenth Day of December, 2004

JON W. DUDAS
*Director of the United States Patent and Trademark Office*